US008900027B2

(12) United States Patent
Bulson et al.

(10) Patent No.: US 8,900,027 B2
(45) Date of Patent: Dec. 2, 2014

(54) PLANAR PLASMA LAMP AND METHOD OF MANUFACTURE

(75) Inventors: Jeffry M Bulson, Hopewell Junction, NY (US); Jay E Pogemiller, New Paltz, NY (US); David Blair DeHaven, Urbana, IL (US); Walter E Mason, Alfred, NY (US); Cyrus M Herring, Urbana, IL (US); Sung-Jin Park, Champaign, IL (US)

(73) Assignee: Eden Park Illumination, Inc., Champaign, IL (US)

( * ) Notice: Subject to any disclaimer, the term of this patent is extended or adjusted under 35 U.S.C. 154(b) by 109 days.

(21) Appl. No.: 13/475,749

(22) Filed: May 18, 2012

(65) Prior Publication Data

US 2012/0319559 A1 Dec. 20, 2012

Related U.S. Application Data

(60) Provisional application No. 61/487,617, filed on May 18, 2011.

(51) Int. Cl.

| | |
|---|---|
| ***H01J 9/00*** | (2006.01) |
| ***H01J 61/30*** | (2006.01) |
| ***H01J 9/24*** | (2006.01) |
| ***H01J 9/14*** | (2006.01) |
| ***H01J 9/02*** | (2006.01) |

(52) U.S. Cl.

CPC ..... *H01J 9/14* (2013.01); *H01J 61/305* (2013.01); *H01J 9/248* (2013.01); *H01J 2261/385* (2013.01); *H01J 9/02* (2013.01)

USPC ..... 445/46; 445/26; 445/29; 445/33; 445/35; 445/52; 313/166; 313/607; 313/291; 313/574

(58) Field of Classification Search

CPC ..... H01J 2261/385; H01J 61/305; H01J 9/14; H01J 9/248; H01J 29/467; H01J 29/26; H01J 29/187; H01J 61/42; H01J 61/44; H01J 61/35; H01J 61/36; H01J 61/34; H01J 61/547; H01J 9/14261; H01J 9/427; H01J 9/26; H01J 9/268; H01J 17/066; H01J 11/12; H01J 9/02; H01J 9/247; H01J 2211/225; H01J 11/22; H01J 65/00; H01L 51/5212; H01L 51/5203; H01L 41/047

USPC ..... 313/422, 493, 634, 607, 484, 485, 514, 313/515, 519, 633, 631, 491, 483, 475, 473, 313/166, 291, 574

See application file for complete search history.

(56) References Cited

U.S. PATENT DOCUMENTS

| | | | |
|---|---|---|---|
| 2,713,754 | A | 7/1955 | David et al. |
| 3,501,662 | A | 3/1970 | Plagge |

(Continued)

*Primary Examiner* — Nimeshkumar Patel
*Assistant Examiner* — Jose M Diaz
(74) *Attorney, Agent, or Firm* — Jeffrey Schox; Diana Lin

(57) ABSTRACT

A lamp including a first and second lamp substrate with a first and second external electrode, respectively, and a first and second internal phosphor coating, respectively, wherein the first phosphor coating is a phosphor monolayer. A method of manufacturing a lamp, including screen-printing a phosphor monolayer on a first lamp substrate; screen-printing a phosphor layer on a second lamp substrate; joining the phosphor-coated faces of the first and second lamp substrates together with a seal; and joining a first and second electrode to the uncoupled exterior faces of the first and second lamp substrates, respectively.

11 Claims, 8 Drawing Sheets

(56) References Cited

U.S. PATENT DOCUMENTS

| | | | | |
|---|---|---|---|---|
| 4,428,764 | A | 1/1984 | Snitzer et al. | |
| 4,671,814 | A | 6/1987 | Aratani et al. | |
| 4,920,298 | A * | 4/1990 | Hinotani et al. | 313/493 |
| 5,284,706 | A | 2/1994 | O'Donnelly | |
| 5,343,115 | A * | 8/1994 | Anandan et al. | 313/491 |
| 5,448,131 | A | 9/1995 | Taylor et al. | |
| 5,519,284 | A * | 5/1996 | Pepi | 313/495 |
| 5,668,353 | A | 9/1997 | Matsuda et al. | |
| 6,144,438 | A | 11/2000 | Izumi | |
| 6,212,852 | B1 | 4/2001 | Tsai | |
| 6,221,190 | B1 | 4/2001 | Shimosato et al. | |
| 6,313,579 | B1 * | 11/2001 | Nakano et al. | 313/493 |
| 6,452,332 | B1 | 9/2002 | Moore | |
| 6,531,818 | B1 * | 3/2003 | Normanni | 313/582 |
| 7,521,272 | B2 | 4/2009 | Kiyomiya et al. | |
| 8,419,965 | B1 * | 4/2013 | Nemeth et al. | 216/97 |
| 2002/0117959 | A1 * | 8/2002 | Winsor | 313/484 |
| 2006/0012305 | A1 * | 1/2006 | Fran et al. | 313/631 |
| 2006/0017392 | A1 * | 1/2006 | Park et al. | 315/169.1 |
| 2006/0091807 | A1 | 5/2006 | Bertin-Mourot et al. | |
| 2006/0103313 | A1 * | 5/2006 | Park et al. | 313/607 |
| 2006/0131522 | A1 * | 6/2006 | Choi et al. | 250/559.36 |
| 2006/0221273 | A1 * | 10/2006 | Ha et al. | 349/65 |
| 2007/0096458 | A1 * | 5/2007 | Yang et al. | 285/102 |
| 2007/0145877 | A1 * | 6/2007 | Hsu et al. | 313/317 |
| 2007/0159052 | A1 * | 7/2007 | Byun et al. | 313/489 |
| 2007/0170835 | A1 * | 7/2007 | Cho et al. | 313/493 |
| 2007/0176553 | A1 | 8/2007 | Kwak | |
| 2007/0210700 | A1 | 9/2007 | Kato et al. | |
| 2007/0247070 | A1 * | 10/2007 | Kim et al. | 313/607 |
| 2008/0012467 | A1 | 1/2008 | Negishi | |
| 2008/0049295 | A1 | 2/2008 | Tonar et al. | |
| 2008/0238292 | A1 * | 10/2008 | Yamamoto et al. | 313/493 |
| 2008/0309851 | A1 * | 12/2008 | Kim et al. | 349/72 |
| 2009/0058295 | A1 | 3/2009 | Auday et al. | |
| 2010/0039040 | A1 | 2/2010 | Whang et al. | |
| 2010/0140511 | A1 | 6/2010 | Auday et al. | |
| 2010/0244658 | A1 * | 9/2010 | Hsu et al. | 313/484 |

* cited by examiner

PLANAR PLASMA LAMP AND METHOD OF MANUFACTURE

CROSS-REFERENCE TO RELATED APPLICATIONS

This application claims the benefit of U.S. Provisional Application No. 61/487,617, filed 18 May 2011, which is incorporated in its entirety by this reference.

TECHNICAL FIELD

This invention relates generally to the planar emissive device field, and more specifically to a new and useful plasma lamp and method of manufacture in the planar emissive device field.

BACKGROUND

Flat fluorescent lamps are planar "light bulbs" that produce light over their entire surface area. Many operate as dielectric barrier discharge lamps, which are constructed of two sheets of glass with external or dielectric-encapsulated internal planar electrodes that are used to produce a plasma discharge. The plasma is energized by a high voltage applied to the electrodes, which produces a breakdown in the gas. The gas breakdown products cause luminescence, usually in a phosphor, such that the lamp produces light.

Conventional flat fluorescent lamp designs rely on complex geometries and structures that require expensive and complex fabrication processes, such as those used for plasma display panel (PDP) production. These processes may include the use of thick film dielectric paste screening and firing, MgO thin film deposition, and photolithography-patterned metal electrodes. The complex construction and expensive manufacturing processes used to make these conventional lamps drive up the costs of the lamp. To be competitive with the ubiquitous light bulb, there is a great need in the planar plasma lamp field to create a new and useful plasma lamp and method of manufacture that reduces lamp costs.

DESCRIPTION OF THE PREFERRED EMBODIMENTS

The following description of the preferred embodiments of the invention is not intended to limit the invention to these preferred embodiments, but rather to enable any person skilled in the art to make and use this invention.

1. System.

Figure 1:
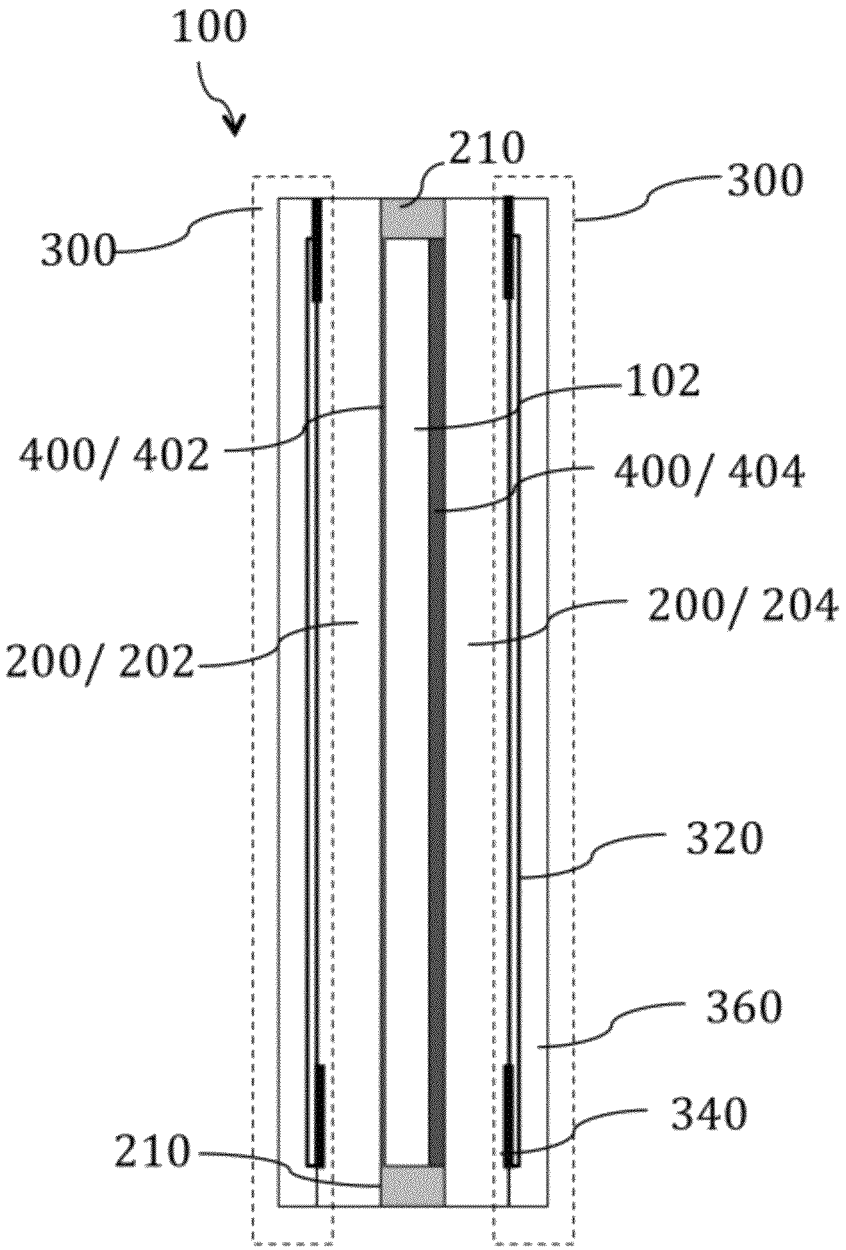
FIG. 1 is a schematic representation of a lamp of the preferred embodiments.

As shown in FIG. 1, the lamp 100 includes a first and second lamp substrate 200 with a pair of external electrodes 300; a first and second phosphor coating 400 on the interior surfaces of the first and second planar lamp substrates 200, respectively, wherein the first and second phosphor coatings 400 have different thicknesses; and a working gas hermetically sealed between the first and second lamp substrates 200. In one variation of the lamp 100, the first phosphor coating 400 is a phosphor monolayer, and the thickness of the second phosphor coating 400 is tailored to optimize luminous flux. In another variation of the lamp 100, the electrodes 300 are blanket films of transparent conductive oxide. This lamp 100 is preferably utilized with a power source to produce visible light over the active area (e.g. the most of the broad face) of the lamp 100. The lamp 100 can be utilized as a light source, as back lighting for a display, or for any other suitable light-emitting purpose.

The construction and manufacture of this lamp 100 can impart several benefits. First, the lamp 100 can yield light output of high quality: the light can be bright, dimmable, of uniform luminance across the surface, have uniform color quality at various emission angles and intensity levels, have a high color rendering index (CRI), have a wide range of available chromaticity, and have good luminous efficacy. Second, the lamp 100 can have a lower manufacturing cost due to a reduced number of parts requiring fewer and less complex manufacturing equipment, and/or a reduced number of manufacturing steps. For example, the lamp substrate 200 functions as the dielectric of the lamp 100, reducing or eliminating the need for an additional dielectric component. As another example, the phosphor coatings 400 can be screen printed, reducing the manufacturing cost through step and equipment reduction. Furthermore, in one variation of the lamp 100, the transparent conductive oxide (TCO) or transparent conductive film can be used as the electrodes 300. Not only does using TCO allow for the buss electrode 340 to be screen-printed without subsequent photolithography processes, but using TCO also reduces the material cost of the lamp 100.

The lamp 100 is preferably utilized with a bipolar-pulsed voltage source using a MOS-FET H-bridge switching topology. A programmable microcontroller produces timing signals to trigger drivers for the MOS-FETs. In one variation, the rail voltage is produced by a power factor correction (PFC) circuit, which converts a universal AC input voltage to about 370 VDC. Dimming can be accomplished by adjusting the pulse repetition frequency (PRF) through 0-10 VDC input to the microcontroller. However, any other suitable voltage source and control circuitry can be used.

The first and second lamp substrates 200 of the lamp 100 support the electrodes 300 and phosphor layers 400, and can additionally function as the dielectric for the lamp 100. The lamp substrates 200 are preferably substantially similar, and preferably have the same dimensions, material, treatments, and dielectric constants. Alternatively, the first and second lamp substrates 200 can have differing parameters. The lamp substrates 200 are preferably planar and prismatic, with two opposing broad faces. The lamp substrates 200 are preferably plates (e.g. rectangular prisms), but can alternatively be curved (e.g. with complimentary curvatures) or have any other suitable geometry. The lamp substrates 200 are preferably glass, more preferably chemically strengthened glass. In one variation, the lamp substrates 200 are made of soda-lime float glass that has been chemically strengthened by sodium ion-potassium ion exchange. However, the lamp substrates 200 can be made of soda-lime container glass, borosilicate glass, any suitable sheet glass, a polymer, or any other suitable material. The lamp substrates 200 can be unstrengthened or strengthened, wherein strengthening can include chemical strengthening, such as ion exchange, lamination, annealing, or any other suitable strengthening method.

Figure 2:
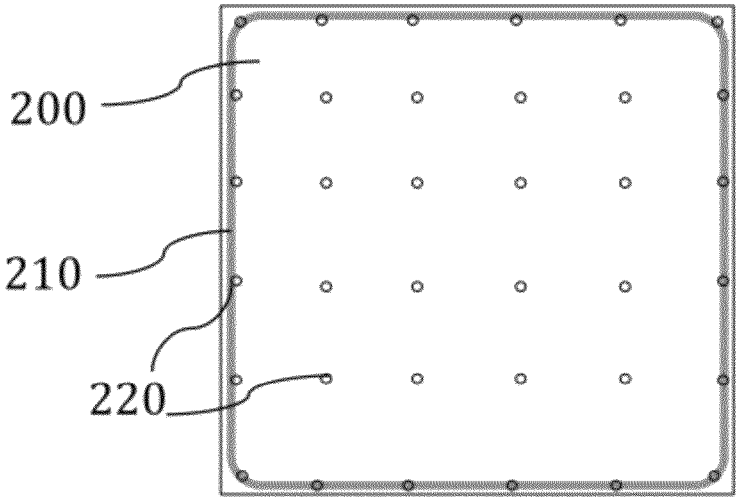
FIG. 2 is a schematic representation of a distribution of spacers within the lamp.

The first and second lamp substrates 200 are preferably hermetically sealed together, and cooperatively define an internal chamber 102. The first and second lamp substrates are preferably sealed together by glass frit 210, but can alternatively be sealed in any suitable manner. The distance between the first and second lamp substrates 200 is preferably substantially uniform, and is preferably maintained by spacers 220. This distance is approximately 1.1 mm, but can alternatively be larger or smaller. The distance is preferably maintained by spherical spacers, wherein the spacers 220 preferably have a diameter substantially similar to the desired separation distance (e.g. 1.1 mm, 0.5 mm, etc.). However, rectangular prismatic, cylindrical, or any other suitable spacer can be used. Alternatively, the spacing may be accomplished by molding the back glass substrate with pre-formed spacers (e.g. bumps) that maintain the spacing between the front and back glass. The spacers 220 are preferably glass, more preferably the same glass as the lamp substrates 200, but can be any suitable material. The spacers 220 are preferably evenly distributed over the active area of the lamp 100 (e.g. across the broad face of the first and second lamp substrates 200), but can alternatively be confined to the lamp/lamp substrate perimeter. As shown in FIG. 2, the spacers 220 are preferably distributed in a grid pattern, but can alternatively be distributed in any other suitable pattern. In one variation, the spacers 220 are placed approximately 0.5 inches-1.5 inches (12.7 mm-38.1 mm) apart. The spacer positions are preferably retained by one of the internal phosphor coatings 400, but can alternatively be retained by glass frit, friction between the spacer and the lamp substrate 200, or by any other suitable mechanism. The lamp substrates 200 are preferably joined by a glass frit 210 about the lamp substrate perimeters, but can be otherwise hermetically sealed.

Figure 3:
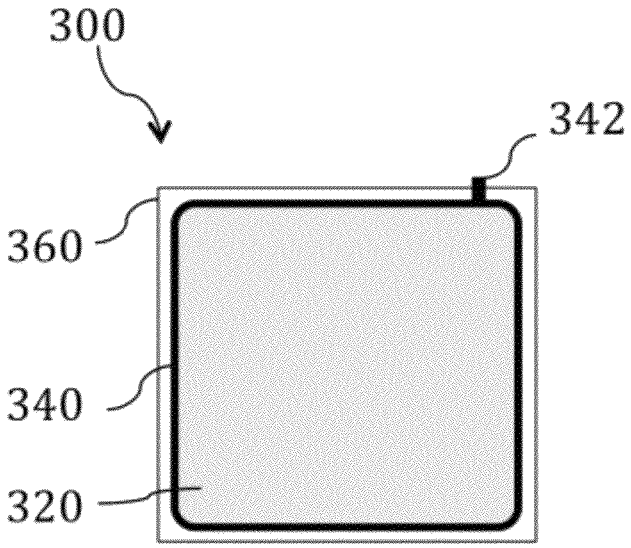
FIG. 3 is a schematic representation of an electrode.
Figure 9:
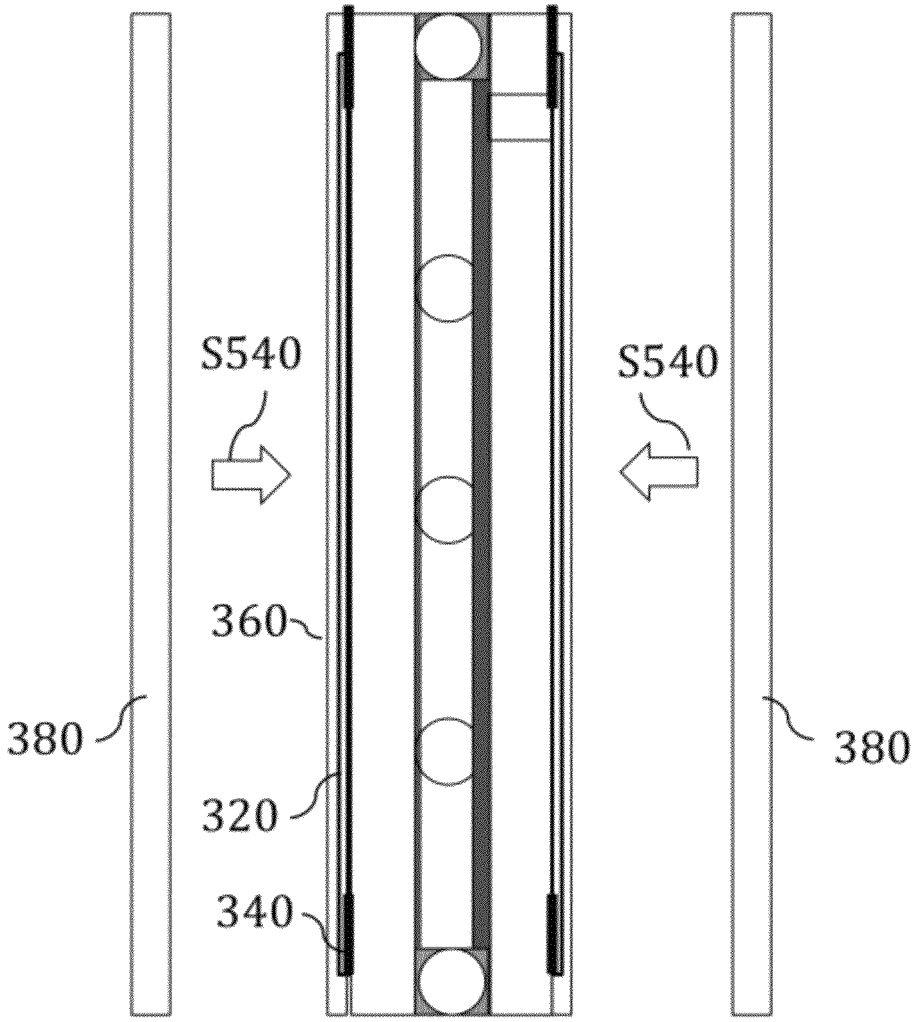
FIG. 9 is a schematic representation of joining a first and second protective substrate to the first and second electrodes.

As shown in FIG. 1, the electrodes 300 of the lamp 100 allow a high voltage to be generated across the lamp thickness to induce a discharge within the lamp 100. The electrodes 300 are preferably external electrodes 300, located on the exterior of the lamp substrates 200, but can alternatively be internal electrodes 300, wherein the electrodes 300 can additionally include dielectric elements. The electrodes are preferably planar electrodes, but can alternatively have any suitable form. Each electrode 300 is preferably directly joined to the lamp substrate 200, but can alternatively be joined by an intermediary film, adherent, or joining medium. As shown in FIG. 3, the electrodes 300 preferably include a discharge electrode 320 supported by an electrode substrate 360, located distal the broad faces of the first and second lamp substrates 200, such that the discharge electrodes 320 are located between the lamp substrate 200 and the electrode substrate 360. The electrode substrate 360 is preferably a glass plate, but can alternatively be a polymeric plate, a polymeric film (e.g. PET film), or any other substrate that can function as an electrode substrate 360. The electrode substrate 360 preferably has a broad face substantially the same size and/or geometry as the broad face of the lamp substrates 200, but can alternatively be larger or smaller. Each discharge electrode 320 is preferably a blanket film, but can alternatively be a patterned electrode 300. The discharge electrodes 320 preferably include transparent conductive films (TCF). The discharge electrodes 320 are preferably inorganic films made of transparent conductive oxide (TCO), such as indium tin oxide (ITO), fluorine-doped tin oxide (FTO), doped zinc oxide, or any other suitable transparent conductive oxide. Alternatively, the electrodes 300 can be made of organic films (e.g. carbon nanotubes, graphine, etc.), transparent conducting polymers (e.g. poly(3,4-ethylenedioxythiophene) [PEDOT], doped PEDOT, poly(4,4-dioctylcyclopentadithiophene), derivatives of polyacetylene, polyaniline, polypyrrole or polythiophene, etc.), or any other suitable transparent conductive film. Alternatively, the discharge electrodes 320 can be patterned metal (e.g. copper, gold, etc.) on a polymer film (e.g. PET film), patterned copper on a glass substrate, a blanket opaque conductor on a polymer film or glass substrate (e.g. in a one-sided lamp), or any other suitable electrode 300. The electrodes 300 are preferably substantially similar, but can alternatively be different (e.g. the first electrode 300 can be a TCO coated glass plate and the second electrode 300 can be a patterned copper PET film). When the electrode substrate 360 is a film, the electrodes 300 preferably additionally include a protective substrate 380 as shown in FIG. 9, coupled to the exterior of the electrode 300 that protects the electrode film. The broad face of the protective substrate 380 preferably has substantially the same geometry as the broad face of the lamp substrate 200 and/or the electrode substrate 360, but can alternatively be larger or smaller. The protective substrate 380 is preferably a glass plate, but can alternatively be a polymeric plate. The lamp 100 preferably includes a first and a second electrode 300 coupled to the first and second substrates, respectively, but can include three, four, or any other suitable number of electrodes.

As shown in FIG. 3, the electrodes 300 each preferably additionally include a buss electrode 340, wherein the buss electrode 340 can reduce the effective resistance of the electrode 300. The buss electrode 340 is preferably disposed about the perimeter of the electrode 300, and is preferably disposed between the lamp substrate 200 and the electrode 300. The buss electrode preferably traces the perimeter of the discharge electrode 320, and does not contact the electrode substrate 380, but can alternatively contact both the discharge electrode 320 and the electrode substrate 380. The buss electrode 340 is preferably silver, but can alternatively be gold, lead, copper, tin, or any other suitable conductive material. The buss electrode layer is preferably approximately 15-40 microns thick, but can alternatively have any suitable thickness. The buss electrode 340 can additionally include terminals 342 (e.g. tin-plated copper terminals, tin terminals, copper terminals, gold terminals, etc.) that extend from the buss terminal to the exterior of the lamp 100 (e.g. extends over the uncovered perimeter of the lamp substrate). The terminals of the first and second lamp substrates 342 can additionally be electrically connected to connectors (e.g. wires, plugs, etc.) that enable connection to the terminals of a power source.

As shown in FIG. 1, the phosphor coatings 400 of the lamp 100 function to emit light when excited by products of the plasma generated from the discharge. The phosphor coatings 400 are preferably located on the interior surfaces of the first and second lamp substrates 200. The first lamp substrate 202 preferably includes a first phosphor coating 400, and the second lamp substrate 204 preferably includes a second phosphor coating 400. In one variation, the first phosphor coating 400 is preferably a phosphor monolayer, wherein the thickness of the first phosphor coating 400 is preferably substantially equivalent to the characteristic dimension (e.g. largest dimension) of a phosphor grain. The first phosphor coating 400 is preferably less than 25 microns thick; in one variation, the first phosphor coating 400 is approximately 6-8 microns thick. However, the first phosphor coating 400 can have any suitable thickness. The second phosphor coating 400 preferably has a thickness that optimizes luminous flux for a particular application. In one variation, the thickness of the second phosphor coating 400 is determined as a multiple of the thickness of the first phosphor coating 400. For example, the thickness of the second phosphor coating 400 can be selected such that ninety percent of light is transmitted through/emitted from the first lamp substrate 202, while ten percent of light is transmitted through/emitted from the second substrate 204. In one variation, the thickness of the second phosphor coating 400 is approximately 40 microns thick. Alternatively, the first and second phosphor layers 400 can have the same thickness or any suitable thickness. The phosphor layers 400 preferably cover substantially the entire broad face of the respective lamp substrates 200, but can alternatively cover only a portion of the broad faces. The phosphor coatings 400 preferably include phosphor grain sizes of approximately 6-8 microns, but can alternatively include phosphor grain sizes of approximately 10 microns, between 1-2 microns to 35 microns, or include phosphor grains of any other suitable size. The phosphor layers 400 can include a single phosphor or a mix of phosphors selected to produce a given emission spectrum for a given application. For example, to produce a color gamut substantially equivalent to a plasma TV, PDP phosphors can be used. For lighting applications, a mixture of phosphors can be chosen to produce white light. The chromaticity for this white light can be chosen with the proper mix of phosphors to achieve the associated correlated color temperature (CCT). Phosphors that can be used include oxides, nitrides and oxynitrides, sulfides, selenides, halides or silicates of zinc, cadmium, manganese, aluminium, silicon, various rare earth metals, or any other suitable phosphor. The first and second phosphor coatings 400 preferably have the same composition of individual phosphor material, but can alternatively have different compositions. However, any other suitable phosphor composition compatible with the working gas can be utilized.

The working gas of the lamp 100 functions to form plasma in response to the high voltage generated between the electrodes 300. The working gas is preferably hermetically sealed in the internal volume defined between the first and second lamp substrates 200. The working gas is preferably a noble gas or a noble gas mixture and can include other materials, such as metal halides, sodium, mercury, or sulfur. In one variation of the lamp, the working gas includes only noble gas, and does not include metal halides, mercury, or sulfur. In another variation of the lamp, the working gas includes neon (Ne) and xenon (Xe), wherein the working gas composition includes 50-100% neon gas and 50-100% xenon gas at a pressure of 100-600 torr. However, the working gas can additionally/alternatively include helium (He), argon (Ar), or krypton (Kr), and can have any other suitable composition.

2. Method of Manufacturing.

Figure 4:
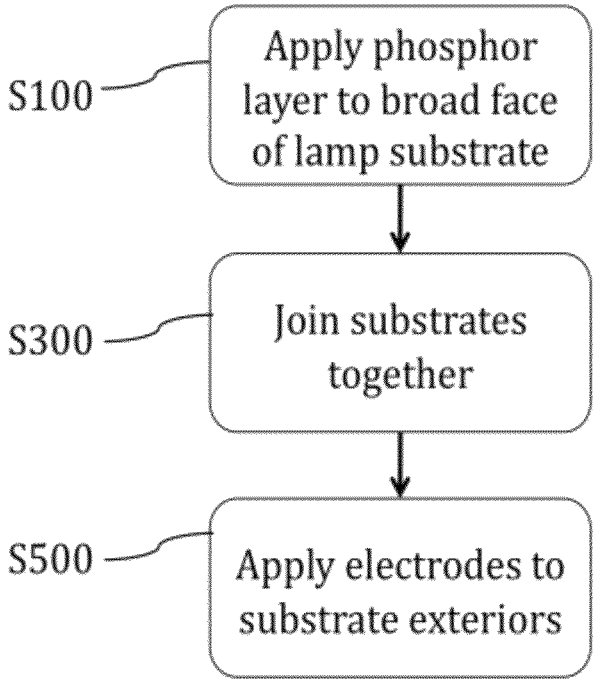
FIG. 4 is a flow diagram of a method of manufacturing a lamp.

As shown in FIG. 4, the method of manufacturing a plasma lamp includes applying a first and second phosphor layer to a broad face of a first and second lamp substrate, respectively S100; joining the first and second lamp substrates together along the perimeter with the phosphor-coated faces on the interior, wherein the first and second lamp substrates are separated by a gap distance S300; and applying electrodes to the exteriors of the first and second lamp substrates S500. In one variation of the method, the first and second phosphor layers are screen-printed onto the lamp substrates. In another variation of the method, the electrode buss is also screen-printed. By screen-printing one or more of the components, this method can reduce the cost of manufacturing. The method preferably produces a lamp substantially similar to the one described above, but can alternatively produce any other suitable plasma lamp.

Figure 5A:
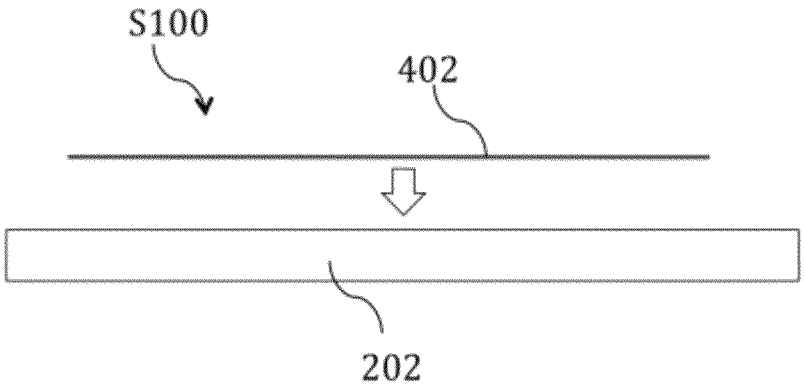
FIGS. 5A and 5B are schematic representations of applying a first and second phosphor layer to a first and second lamp substrate, respectively.
Figure 5B:
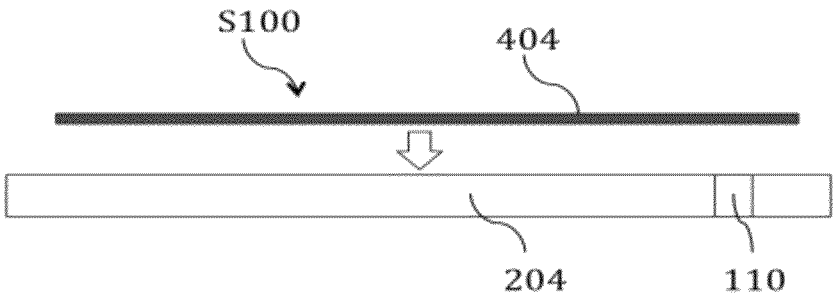

Applying a first and second phosphor layer to a broad face of a first and second lamp substrate S100 functions to apply the first and second phosphor coating 400 over the interior surfaces of the lamp substrates 200. The phosphor layers 400 are preferably screen-printed (silkscreened, serigraphed, serigraph printed) onto the broad faces of the lamp substrates 200, but the broad faces can be otherwise coated with phosphor (e.g. sprayed, dipped, painted, etc.). As shown in FIGS. 5A and 5B, the phosphor layers 400 are preferably deposited as a blanket film over the broad faces of the lamp substrates 200, wherein the phosphor layers 400 preferably cover the majority of the broad faces of the lamp substrates 200, except for the broad face perimeters. However, the phosphor layers 400 can alternatively cover the entire broad faces of the lamp substrates 200 (e.g. wherein the frit seals along the edges of the lamp substrate that are normal the broad faces), be patterned or stenciled onto the broad faces such that the phosphor layer 400 only covers a portion of the respective broad face, or be deposited in any suitable pattern. For example, three different screens can be used in succession to print a checkered pattern of three different phosphors (e.g. red, green, and blue). The phosphor layer 400 thicknesses are preferably substantially uniform, but can alternatively be variable. The first phosphor layer 402, which covers a broad face of the first lamp substrate 202, is preferably substantially thin, more preferably a phosphor monolayer. The first phosphor layer 402 is preferably less than 25 microns thick, more preferably between 6-8 microns thick. However, the first phosphor layer 402 can have any suitable thickness. The second phosphor layer 404, covering a broad face of the second lamp substrate 204, is preferably thicker than the first phosphor layer 402, wherein the thickness is preferably selected depending on the given application. The second phosphor layer 404 is preferably applied as a single coating/layer, but can alternatively be formed from multiple coatings/layers. Alternatively, the second phosphor layer 404 can be thicker, thinner, or the same thickness as the first phosphor layer 402. The phosphor layers 400 are preferably made of the different phosphor compositions, wherein the composition for the first phosphor layer is preferably formulated to enable phosphor monolayer screen-printing, and the composition for the second phosphor layer is formulated to enable phosphor layer screen-printing of the desired thickness. Alternatively, the first and second phosphor layers 400 can have any suitable phosphor composition. Applying a first and second phosphor layer 400 to a broad face of a first and second lamp substrate 200 can additionally include drying the phosphor layers 400. However, applying the first and second phosphor layers 400 can alternatively include dip-coating the lamp substrates 200 and removing excess phosphor, depositing the phosphor layer 400 using particle deposition, depositing the phosphor layer 400 with a phosphor spray process, or any other suitable method of applying a phosphor layer 400 to a lamp substrate face.

Figure 6:
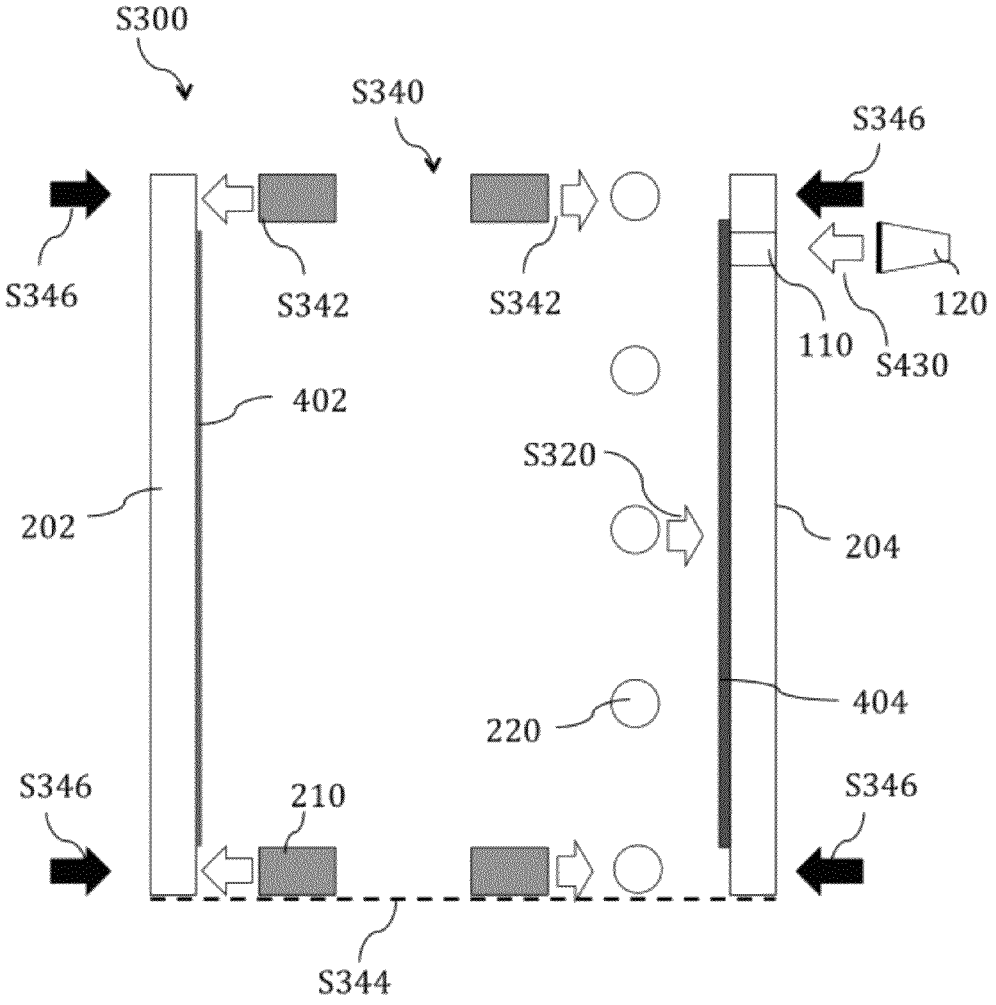
FIG. 6 is a schematic representation of joining the substrates together.

Joining the first and second lamp substrates together S300 functions to form a substantially hermetic seal between the perimeters of the first and second lamp substrates 200 and to define the internal chamber 102 that contains a working gas. The lamp substrates 200 are preferably joined together after phosphor layer application. As shown in FIG. 6, joining the first and second lamp substrates together preferably includes positioning spacers on a broad face of a lamp substrate S320 and joining the lamp substrates together using glass frit bonding (glass soldering, seal glass bonding) S340.

Positioning the spacers S320 preferably defines the final separation distance (gap distance) between the first and second lamp substrates 200. The spacers 220 are preferably spherical spacers with a diameter substantially equivalent to the desired separation distance, but can alternatively be prismatic spacers 220 or have any other suitable geometry. The spacers 220 are preferably positioned in an even distribution over the broad face of a lamp substrate 200, such as in a grid pattern, but can alternatively be only positioned along the perimeter of the broad face, positioned in a random distribution, or positioned in any suitable manner. Positioning spacers 220 on a broad face of a lamp substrate 200 preferably includes placing the spacers 220 in the desired distribution onto a wet phosphor layer 400 that covers a broad face of a lamp substrate 200, before the phosphor layer 400 has been dried. The spacers 220 are preferably placed on one lamp substrate 200, but can alternatively be placed on both lamp substrates 200. One variation of the method includes pressing the spacers 220 into the wet phosphor layer 400 of the second lamp substrate 204 in the desired distribution, then drying the second phosphor layer 404. Alternatively, the spacers 220 can be included in the frit paste, wherein application of the frit paste during glass frit bonding simultaneously positions the spacers 220 on the broad face of a lamp substrate 200. Alternatively, the spacers 220 can be positioned on a phosphor-coated broad face after the phosphor layer 400 has been dried.

Joining the lamp substrates together using glass frit bonding S340 functions to form a substantially hermetic perimeter seal between the two lamp substrates 200. Glass frit bonding preferably includes: applying a bead of frit paste to the perimeter of a phosphor-coated broad face S342; drying the frit paste; aligning the first and second lamp substrates S344; applying a substantially normal, compressive force against the broad faces of first and second lamp substrates S346; and heating the assembly to flow the frit. The frit paste is preferably applied to the phosphor-coated broad faces of both the first and second lamp substrates 200, but can alternatively be applied to only the phosphor-coated broad face of the first lamp substrate 202 or only the phosphor-coated broad face of the second lamp substrate 204. The frit paste preferably traces substantially the entirety of the broad face perimeter, wherein the frit bead is preferably substantially continuous, but the frit paste can alternatively be applied as a plurality of beads or strips. Frit paste application can additionally include imbedding spacers 220 into the wet frit paste before drying. In one variation of the method, the frit bead is approximately 2-3 mm wide. Aligning the first and second lamp substrates 200 preferably includes aligning the edges of the lamp substrates 200, wherein the first and second lamp substrates 200 preferably have substantially the same geometry. The lamp substrates 200 are preferably arranged with the phosphor-coated faces proximal each other (e.g. on the interior), but can alternatively be arranged with the phosphor-coated faces on the exterior. The lamp substrates 200 can be aligned by placing the first and second lamp substrates 200 in a guide, or aligned in any suitable manner. The normal, compressive force is preferably applied to the lamp substrates 200 after lamp substrate alignment. The normal, compressive force is preferably substantially evenly applied to the perimeter of the lamp substrates 200, more preferably over the area including the frit paste. Alternatively, the compressive force can be substantially evenly distributed over the broad faces of the lamp substrates 200. The compressive force is preferably applied by a plurality of clips (e.g. evenly distributed about the assembly perimeter), but can alternatively be applied by a pressure plate, by a pressurized chamber, or any other suitable pressure application mechanism. Heating the assembly to flow the frit preferably includes heating the assembly (e.g. in an oven) above either the sintering or flow temperature for the frit paste.

Figure 7:
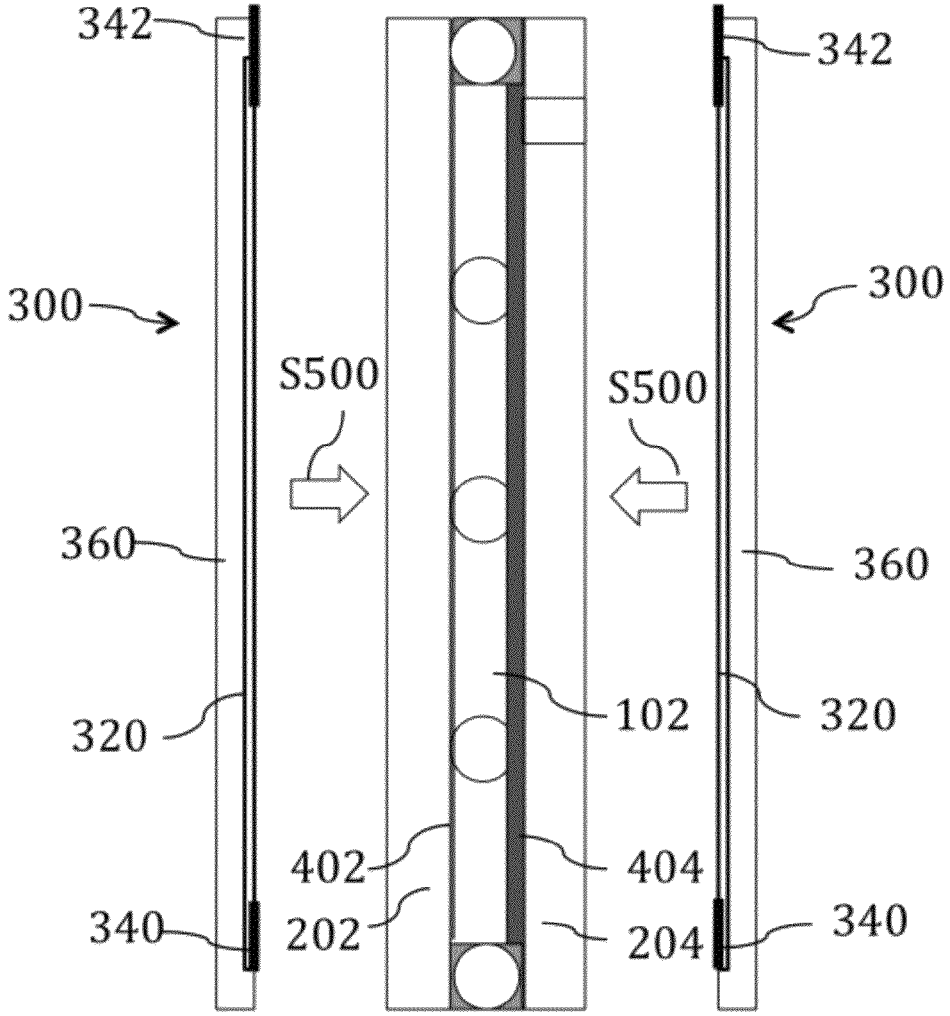
FIG. 7 is a schematic representation of applying the electrodes to the substrate exteriors.

Applying electrodes to the exteriors of the first and second lamp substrates S500 couples the electrodes 300 to the lamp exterior. As shown in FIG. 7, a first electrode 300 is preferably coupled to the uncoupled broad face of the first lamp substrate 202, and a second electrode 300 is preferably coupled to the uncoupled broad face of the second lamp substrate 204. The electrodes 300 are preferably blanket films, but can alternatively be patterned. The electrodes 300 are preferably substantially the same size as the respective uncoupled broad face, but can alternatively be larger or smaller. The electrodes 300 preferably include transparent conductive films of transparent conductive oxide (TCO), but can alternatively be patterned metal such as copper, nickel, chrome, or any other suitable electrode material. The electrodes 300 can additionally include buss electrodes 340, wherein the buss electrodes 340 are disposed between the electrode 300 and the lamp substrate 200 in the final assembly. The buss electrodes 340 are preferably conductive silver, but can alternatively be copper, gold, or any other suitable conductive material. The buss electrode layer is preferably 15-40 microns thick, but can alternatively be any suitable thickness. The first and second electrodes 300 are preferably substantially similar, but can alternatively be different (e.g. different sized blanket films, different patterning, different buss electrode 340 patterns, etc.). Each electrode 300 is preferably supported by an electrode substrate 360, such as a glass plate, polymeric plate, polymeric film (e.g. PET film), or any other suitable lamp substrate 200 for an electrode 300. In one variation, the electrodes 300 include TCO blanket films on glass plates. In another variation, the electrodes 300 include copper electrodes on PET film, patterned by photolithography processes. However, any other suitable electrodes 300 can be used.

Electrode application to the lamp exterior S500 preferably includes laminating the broad face of electrodes 300 to the uncoupled broad faces of the first and/or second broad face of the lamp exterior. The electrodes 300 are preferably laminated to the uncoupled broad faces with adhesive, but can alternatively be laminated using any other suitable lamination method. In one variation, UV-curable adhesive, such as optical grade UV-curable epoxy, is used; however, any other suitable epoxy or adherent can be used. In one variation of the method, electrode application includes applying epoxy, aligning the electrode 300 and the uncoupled broad face of the lamp substrate 200, applying a compressive force on the electrode 300 against the broad face of the lamp substrate 200, and curing the epoxy. The epoxy can be applied to the electrode 300, the uncoupled broad face and/or the side of the electrode substrate 360 that includes the electrode 300. The electrodes 300 are preferably aligned by aligning the electrode substrates 360 with the uncoupled broad face of the lamp substrate 200. Clips, guides, or any other suitable alignment mechanism can be used. The alignment mechanisms used in glass frit sealing the first and second lamp substrates together are preferably used, but other alignment mechanisms can alternatively be used. The electrodes 300 are preferably aligned with the electrodes 300 proximal the uncoupled broad face of the lamp substrate 200 and the electrode substrates 360 distal the uncoupled broad face of the lamp substrate 200. Force is preferably applied to the electrode 300 in a substantially normal direction, but can alternatively be applied at an angle relative to normal. Force is preferably applied to the face of the electrode substrate 360 opposing that supporting the electrode 300, but can alternatively be applied to any suitable face. Force is preferably applied by a pressure plate, but can alternatively be applied by a roller or any other suitable force application mechanism. Curing the epoxy preferably includes exposing the assembly to UV light, but can alternatively include exposing the epoxy to oxygen or any other suitable curing reagent or catalyst.

However, the electrodes 300 can be directly formed on the uncoupled broad faces or joined to the uncoupled broad face of the lamp substrates 200 in any suitable manner.

Applying the electrodes 300 to the uncoupled broad face can additionally include forming the electrodes before electrode application S520. The electrodes 300 are preferably formed from electrode substrates 360 that have been precoated with conductive material (e.g. TCO-coated glass substrates from a manufacturer), wherein the conductive material functions as the discharge electrode 320. In one variation, the electrode substrates 360 are pre-coated with conductive material during the glass manufacturing process. For example, a TCO film can be produced on the glass float line at the same time that the glass electrode substrate 360 is being made. However, the electrodes 300 can be formed from uncoated electrode substrates 360, wherein forming the electrodes 300 further includes depositing conductive material on the electrode substrates S522 to form discharge electrodes 320. Depositing conductive material on the electrode substrates S522 can include screen-printing a blanket film of conductive material on the electrode substrate 360, screen-printing an electrode pattern onto the electrode substrate 360 (e.g. using a pattern that prevents the conductive material from being applied to the perimeter of the electrode substrate 360), patterning electrodes 320 (e.g. copper electrodes) onto the electrode substrate 360 using photolithography techniques on blanket films produced using particle deposition, metal organic chemical vapor deposition (MOCVD), metal organic molecular beam deposition (MOMBD), spray pyrolysis, and pulsed laser deposition (PLD), sputtering (e.g. magnetron sputtering) or any other suitable electrode forming technique.

Figure 8:
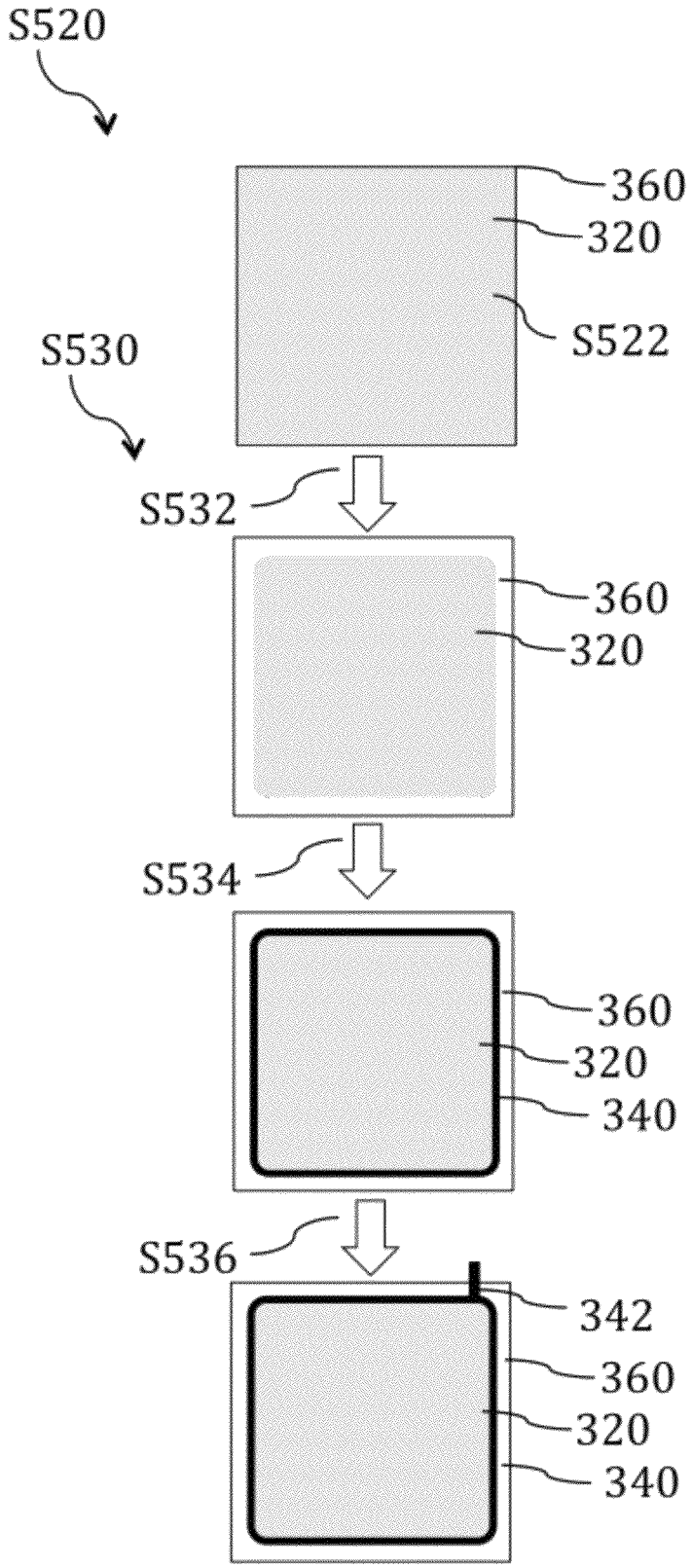
FIG. 8 is a schematic representation of fabricating an electrode.

As shown in FIG. 8, forming the electrodes preferably additionally includes forming a buss electrode over the conductive material S530. Forming a buss electrode 340 preferably includes: removing the conductive material from the perimeter of the electrode substrate S532; depositing the buss electrode over the conductive material/discharge electrode S534; and firing the buss electrode. The conductive material of the discharge electrode 320 (e.g. TCO, copper, etc.) is preferably removed from the perimeter of the electrode substrate 360 to prevent creepage from the electrode 300 to the outside of the lighting tile. However, the conductive material can be left on the perimeter. Removing conductive material can include powder blast abrading, wet chemical etch (such as HF), laser ablation, or any other suitable method. Buss electrode 340 deposition is preferably accomplished by screen-printing the buss electrode 340 about the perimeter of the electrode 300. More preferably, the buss electrode 340 is screen-printed onto the discharge electrode 320 up to the edge of the remaining film after film removal S532, such that a major portion of the buss electrode 340 covers the conductive material. However, the buss electrode 340 can be screen-printed such that the buss electrode covers both the discharge electrode 320 and the electrode substrate 360. Alternatively, the buss electrode 340 can be extruded, deposited using particle deposition, or deposited in any other suitable manner in any suitable pattern. The buss electrode 340 is preferably silver, but can alternatively be gold, copper, or any other suitable conductive material.

As shown in FIG. 8, forming the electrodes can additionally include attaching electrical contacts to the buss electrode S536, which functions to provide external contacts after the electrodes 300 have been laminated to the first and second lamp substrates 200. These electrical contacts can additionally be electrically connected to power connectors (e.g. soldering, crimping, etc. wires, plugs, etc. to the electrical contacts) that enable electrical connection to the terminals of a power supply. The electrical contacts 342 preferably include tin-coated copper ribbon, but can alternatively include any other suitable electrical contact. Attaching electrical contacts 342 to the buss electrode 340 preferably includes soldering the electrical contacts to the buss electrode 340, with a portion of the electrical contact 342 overhanging the electrode substrate 360. However, the electrical contacts 342 can be screen-printed onto the buss electrode 340 (e.g. wherein a guide supports the overhanging portion of the electrical contact) or coupled to the buss electrode 340 in any suitable manner.

When the electrode substrate 360 is a film, applying the electrodes 300 to the first and second substrates can additionally include coupling a protective substrate to the electrode S540, as shown in FIG. 9. The protective substrate 380 can be coupled to the electrode 300 after the electrode 300 is joined to the lamp substrate 200, or can be coupled to the electrode 300 before the electrode 300 is joined to the lamp substrate 200. When the protective substrates 380 are coupled to the electrodes after electrode application to the lamp substrates S500, both electrodes 300 are preferably first joined to the lamp substrates 200, after which the protective substrates 380 are joined to the electrodes 300. However, the protective substrate 380 can alternatively be coupled to the respective electrode 300 before joining the next electrode to the lamp substrate. The protective substrate 380 is preferably coupled to the electrode substrate 360, distal the conductive material, but can alternatively be coupled to any suitable portion of the electrode 300. The protective substrate 380 is preferably laminated to the electrode 300, but can be otherwise coupled. The support structure is preferably laminated using an adhesive, more preferably a UV-curable adhesive such as optical grade UV-curable epoxy, but can be laminated using any other suitable adhesive.

The method can additionally include providing the internal chamber with a working gas S400. Providing the internal chamber with a working gas preferably includes: providing an opening to the internal chamber S420; evacuating the internal chamber S440, filling the internal chamber with a working gas S460, and sealing the opening S480. Providing the internal chamber 102 with a working gas is preferably performed after phosphor layer application but before electrode application.

Figure 10:
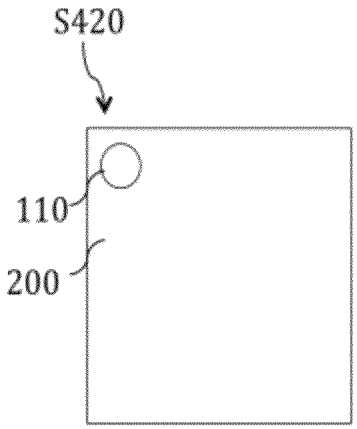
FIG. 10 is a schematic representation of providing an opening through the thickness of a lamp substrate.
Figure 11:
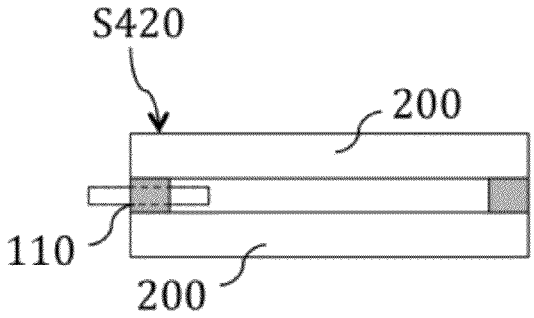
FIG. 11 is a schematic representation of a variation of providing an opening.

Providing an opening into the internal chamber S420 functions to allow fluid access to the internal chamber 102 after the perimeter of the first and second lamp substrates 200 have been sealed together. In one variation, as shown in FIG. 10, the opening 110 is provided through the thickness of a lamp substrate 200. The opening 110 is preferably provided through the second lamp substrate 204, but can alternatively be provided through the first lamp substrate 202. The opening 110 is preferably provided in a corner of the lamp substrate 200, but can alternatively be provided through any suitable portion of the lamp substrate 200. The opening 110 is preferably formed during manufacture of the lamp substrate 200, wherein the lamp substrate 200 is preferably molded or formed with the opening 110. However, the opening no can be formed through post-processing of the lamp substrate 200, and can be a hole that is drilled, punched, or otherwise created through the thickness of the lamp substrate 200. In this alternative, the lamp substrate 200 is preferably cleaned before and after hole formation (e.g. washed with detergent). Hole formation preferably occurs before glass strengthening, if glass strengthening is used. In another variation, as shown in FIG. 11, the opening 110 is provided through the frit seal, such that the opening 110 extends parallel to the broad faces of the lamp substrates 200. In this variation, a tube 120 is preferably laid on the phosphor-coated face of a lamp substrate 200 such that the tube end extends over the lamp substrate edge, wherein the bead of frit paste is preferably applied around a portion of the tube 120. The tube position is preferably secured during frit paste drying. However, any other suitable means of providing an opening no can be used.

Providing the opening can additionally include joining a tube to the opening S430, which functions to provide a fluid path to the internal chamber 102 after sealing the perimeters of the first and second lamp substrates together. The tube 120 can additionally function as an opening sealant. The tube 120 is preferably a hollow, flared tube, but can alternatively be a hollow cylindrical tube or have any suitable geometry. The tube 120 is preferably glass, more preferably substantially the same glass as the lamp substrate 200, but can alternatively be a polymer or any other suitable material. In one variation, as shown in FIG. 6, joining a tube with the opening S430 includes applying a bead of frit along the edge of the tube, coupling the tube end with the frit to the opening, and heating the frit to join the tube with the lamp substrate. The bead of frit is preferably applied to the wide end of the flared tube 120, but can alternatively be applied to the narrow end of the flared tube 120. The tube end is preferably substantially the same geometry as the opening 110, but can alternatively be larger. The tube end is preferably coupled to the exterior surface of the second lamp substrate 204, wherein the tube 120 is preferably coaxially aligned with the opening no. The tube end is preferably coupled to the second lamp substrate 204 using clamps or clips, but can alternatively be held in position by a guide (e.g. the same guide that aligns the lamp substrates 200), or positioned in any suitable manner. The tube 120 is preferably joined and/or sealed against the lamp substrate 200 in the same heating step that seals the first and second lamp substrate 200, but can alternatively be joined before or after the first and second lamp substrates 200 have been joined together.

Figure 12:
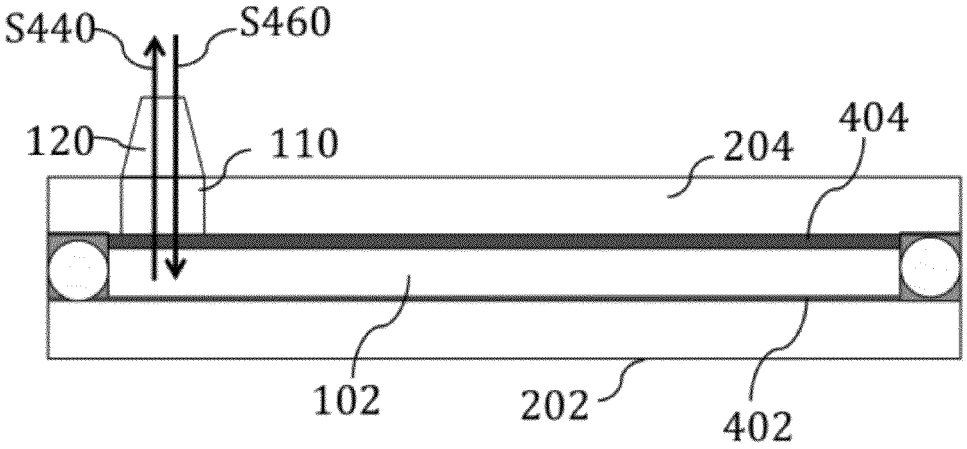
FIG. 12 is a schematic representation of evacuating the internal chamber and filling the internal chamber with a working gas.

As shown in FIG. 12, evacuating the internal chamber S440 preferably includes generating a low pressure within the internal chamber 102 through the opening 110, wherein air and moisture is pumped or pulled out of the internal chamber 102. Internal chamber evacuation is preferably performed after joining the first and second lamp substrates 200. Internal chamber evacuation is preferably performed at a temperature higher than room temperature, more preferably near the vaporization point of water, such that moisture within the internal chamber 102 can be removed as water vapor. Internal chamber evacuation is preferably performed with a vacuum pump, or any other suitable low pressure generator. The low pressure generator preferably attaches to the tube 120, but can alternatively directly couple to the opening 110 (e.g. through a suction seal).

As shown in FIG. 12, filling the internal chamber with a working gas S460 preferably includes back-filling the working gas into the internal chamber 102 after evacuating the internal chamber 102. Internal chamber filling S460 is preferably performed at room temperature after internal chamber evacuation S440, wherein the assembly is preferably cooled before internal chamber filling. The internal chamber is preferably filled with a noble gas mixture, such as equal parts of neon and xenon. The internal chamber 102 is preferably filled through the opening no. The working gas source preferably couples to the tube 120, but can alternatively directly couple to the opening no (e.g. through a seal).

Figure 13:
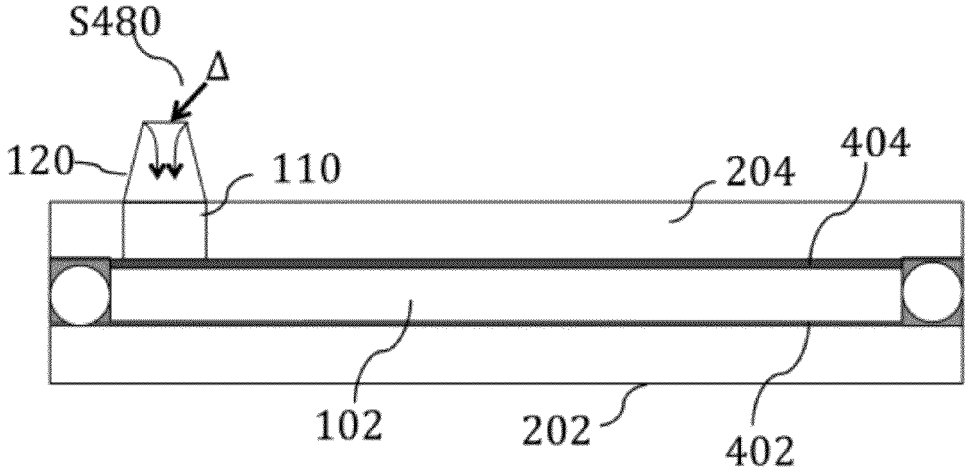
FIG. 13 is a schematic representation of a variation of sealing the opening.

Sealing the opening S480 preferably functions to hermetically seal the working gas between the first and second lamp substrates 200, and can additionally function to provide a substantially smooth surface for electrode application. As shown in FIG. 13, the opening no is preferably sealed by radially collapsing the free end of the tube, which is preferably accomplished by localized heating of the free end to melting temperatures. However, the opening 110 can be sealed by flowing frit paste over the opening no, or by using any other suitable method.

The method can additionally include processing the lamp substrates, preferably after providing the opening 110 but alternatively before. Substrate processing preferably includes strengthening the substrate, but can include buffing the substrate, clarifying the substrate, or any other suitable processing step. In one variation of the method, processing the lamp substrate includes strengthening a glass substrate by immersion in a potassium salt bath, such as a potassium nitrate solution, with or without potassium silicate, at elevated temperatures. This is preferably used when the lamp substrate 200 includes soda-lime glass. In another variation of the method, processing the lamp substrate includes both chemical strengthening and glass lamination. However lamination, heat treatment, or any other suitable method can additionally/alternatively be used to strengthen the lamp substrates.

One variation of the method includes: screen-printing a first and second phosphor layer on a broad face of a first and second glass plate, respectively; coupling the phosphor-coated faces of the first and second glass plates together; screen-printing a first and second electrode buss onto an electrode substrate; and coupling the first and second electrode to the uncoupled broad faces of the first and second electrode, respectively.

Another variation of the method includes: providing a first and second glass plate; drilling a hole through the corner of the second glass plate; cleaning the first and second glass plates; strengthening the first and second glass plates by immersion in a potassium nitrate salt bath; cleaning the first and second glass plates; screen-printing a broad face of each of the first and second glass plates with phosphor, wherein the broad face of the first glass plate is coated with a phosphor monolayer, and the broad face of the second glass plate is coated with a phosphor layer having a thickness greater than the phosphor monolayer; placing internal spacers into the phosphor layer coating the broad face of the second glass plate; drying the phosphor monolayer and the phosphor layer; applying a bead of frit about the perimeters of the phosphor-coated broad faces; aligning and coupling the phosphor-coated broad faces of the first and second glass plates; applying a normal, compressive force to the uncoupled faces of the glass plates; applying a bead of frit to a glass tube; coaxially aligning the tube with the hole, with the frit proximal the uncoupled face of the second glass plate; heating the assembly to frit flow temperatures to seal the first and second glass plates and to seal the tube to the second glass plate; evacuating the interior chamber defined between the sealed first and second substrates through the tube; backfilling the interior chamber with a working gas through the tube; sealing the hole by locally heating the free end of the tube, such that the tube collapses radially inward; removing transparent conductive oxide (TCO) from the perimeter of a first and second TCO-coated glass substrate; screen-printing a first and second silver buss electrode about the perimeter of the first and second TCO-coated glass substrates, wherein the buss electrodes extend onto the TCO-coated portions of the glass substrates; firing the buss electrodes; soldering leads to solder pads on the buss electrodes; and laminating the first and second TCO-coated substrates against the uncoupled broad faces of the first and second glass plates, respectively, wherein the buss electrodes and TCO layers are proximal the respective glass plate.

Another variation of the method is substantially similar to that described above, but uses PET films with copper electrodes instead of TCO-coated glass substrates. In this variation, the method includes the additional steps of laminating a first and second piece of protective glass over the uncoupled broad faces of the first and second PET films, respectively.

However, any suitable combination of the aforementioned actions in any suitable order can be utilized to manufacture a lamp.

As a person skilled in the art will recognize from the previous detailed description and from the figures and claims, modifications and changes can be made to the preferred embodiments of the invention without departing from the scope of this invention defined in the following claims.

We claim:

1. A method of manufacturing a plasma lamp, comprising:

screen printing a first phosphor layer on a broad face of a first planar lamp substrate;

screen printing a second phosphor layer on a second broad face of a second planar lamp substrate;

sealing the perimeters of the first and second broad faces together, wherein the first and second broad faces are positioned a separation distance apart;

fabricating a first and second electrode, comprising:

screen-printing a first and second buss electrode along the perimeter of a broad face of a first and second electrode substrate, the electrode substrates each comprising a glass plate coated on a broad face with a transparent conductive film comprising transparent conductive oxide, wherein screen-printing the first and second buss electrodes comprises:

removing the transparent conductive oxide from perimeters of the glass plates; and screen-printing the first and second buss electrodes over the respective transparent film along the transparent film perimeter;

joining the first electrode to a third broad face after fabricating the first electrode, the third broad face comprising an uncoupled broad face of the first substrate; and joining the second electrode to a fourth broad face after fabricating the second electrode, the fourth broad face comprising an uncoupled broad face of the second substrate.

2. The method of claim 1, wherein the first phosphor layer is a phosphor monolayer, the monolayer having a thickness approximately equivalent to the largest dimension of a phosphor grain.

3. The method of claim 2, wherein the second phosphor layer comprises a thickness that facilitates approximately ninety percent of produced light to be emitted from the first plate and approximately ten percent of the produced light to be emitted from the second plate.

4. The method of claim 1, wherein the method further comprises depositing spherical spacers into the second phosphor layer, the spherical spacers having a diameter substantially equivalent to the separation distance between the first and second substrates.

5. The method of claim 1, wherein the second plate further comprises an opening through the thickness of the second plate.

6. The method of claim 5, wherein sealing the perimeters of the first and second broad faces comprises:

applying frit paste to an edge of a hollow tube, the tube edge defining substantially the same geometry as the opening;

aligning the tube coaxially with the opening, the tube edge proximal the fourth broad face; and coupling the tube to the fourth broad face;

wherein sealing the perimeters of the first and second broad faces concurrently joins the tube with the second plate.

7. The method of claim 6, wherein the method further comprises heating a tube end distal from the fourth broad face to collapse the tube and seal the opening.

8. The method of claim 5, further comprising:

baking the first and second substrates with a lowered pressure in the internal chamber after sealing together the first and second broad faces, wherein the low pressure is generated through the opening; and filling the internal chamber with a working gas through the opening.

9. The method of claim 1, wherein joining the first electrode to the third broad face comprises laminating the first electrode against the third broad face; and joining the second film to the fourth broad face comprises laminating the second electrode against the fourth broad face.

10. The method of claim 1, wherein the first and second substrates comprise soda-lime float glass, wherein the method further comprises strengthening the first and second substrates.

11. The method of claim 10, wherein strengthening the first and second substrates comprises chemically strengthening the glass.

* * * * *